US009307798B1

(12) United States Patent
Mao

(10) Patent No.: US 9,307,798 B1
(45) Date of Patent: Apr. 12, 2016

(54) HEADWEAR MEMBER WITH HEADBAND

(71) Applicant: Yongzhong Mao, Newport Coast, CA (US)

(72) Inventor: Yongzhong Mao, Newport Coast, CA (US)

( * ) Notice: Subject to any disclaimer, the term of this patent is extended or adjusted under 35 U.S.C. 154(b) by 0 days.

(21) Appl. No.: 14/101,204

(22) Filed: Dec. 9, 2013

(51) Int. Cl.
*A42B 1/00* (2006.01)

(52) U.S. Cl.
CPC ..... *A42B 1/004* (2013.01)

(58) Field of Classification Search
CPC ..... A42B 1/22; A42B 7/00; A42C 5/02
USPC ..... 2/209.12, 175.1, 195.1, 195.2, 195.3, 2/195.4, 209.13
See application file for complete search history.

(56) References Cited

U.S. PATENT DOCUMENTS

| | | | | |
|---|---|---|---|---|
| 4,993,079 | A * | 2/1991 | Johnson | 2/181 |
| 6,493,880 | B1 * | 12/2002 | Lo | 2/195.2 |
| 6,567,991 | B1 * | 5/2003 | Holslag et al. | 2/181.4 |
| 2004/0199979 | A1 * | 10/2004 | Ngan | 2/195.1 |
| 2007/0130669 | A1 * | 6/2007 | Rogers | 2/195.1 |
| 2007/0250988 | A1 * | 11/2007 | Hwang | 2/209.13 |
| 2007/0256213 | A1 * | 11/2007 | Dunavin | 2/171 |
| 2010/0024091 | A1 * | 2/2010 | Mehtab et al. | 2/69 |

* cited by examiner

*Primary Examiner* — Anna Kinsaul

(57) ABSTRACT

A baseball cap has a band of material positioned at a base of a crown portion of the cap. The band may be formed of a first strip of material, such as spandex, that is stretchable along a direction that coincides with the length of the band or a direction perpendicular to the length of the band. The band includes a binding or second strip of material or binding that is adhered to the band using a heating process.

13 Claims, 4 Drawing Sheets

HEADWEAR MEMBER WITH HEADBAND

BACKGROUND

A headwear device, such as a baseball cap, typically includes a crown portion that fits on a wearer's head and a bill or visor portion that extends forward to shade the wearer's eyes. A band of material is often positioned on the cap at the base of the crown portion. The band may be made of an elastic material that is configured to secure the crown of the cap to the wearer's head.

It may be desirable to provide the band portion with alphanumeric characters or graphics. Such characters or graphics may simply be decorative or they may identify characteristics of the cap, such as size, logo, etc.

There is a need for improved bands for use in headwear devices such as baseball caps.

SUMMARY

Disclosed herein is a headwear member, such as a baseball cap, having a band of material positioned at a base of a crown portion of the cap. The band may be formed of a first strip of material, such as spandex, that is stretchable along a direction that coincides with the length of the band or a direction perpendicular to the length of the band. The band includes a binding or second strip of material or binding that is adhered to the band using a heating process. The second strip of material is suitable for printing alphanumeric characters or graphics thereon. The second strip of material is secured to the first strip using a heat process.

The details of one or more variations of the subject matter described herein are set forth in the accompanying drawings and the description below. Other features and advantages of the subject matter described herein will be apparent from the description and drawings, and from the claims.

DETAILED DESCRIPTION

Before the present subject matter is further described, it is to be understood that this subject matter described herein is not limited to particular embodiments described, as such may of course vary. It is also to be understood that the terminology used herein is for the purpose of describing a particular embodiment or embodiments only, and is not intended to be limiting. Unless defined otherwise, all technical terms used herein have the same meaning as commonly understood by one skilled in the art to which this subject matter belongs.

Figure 1:
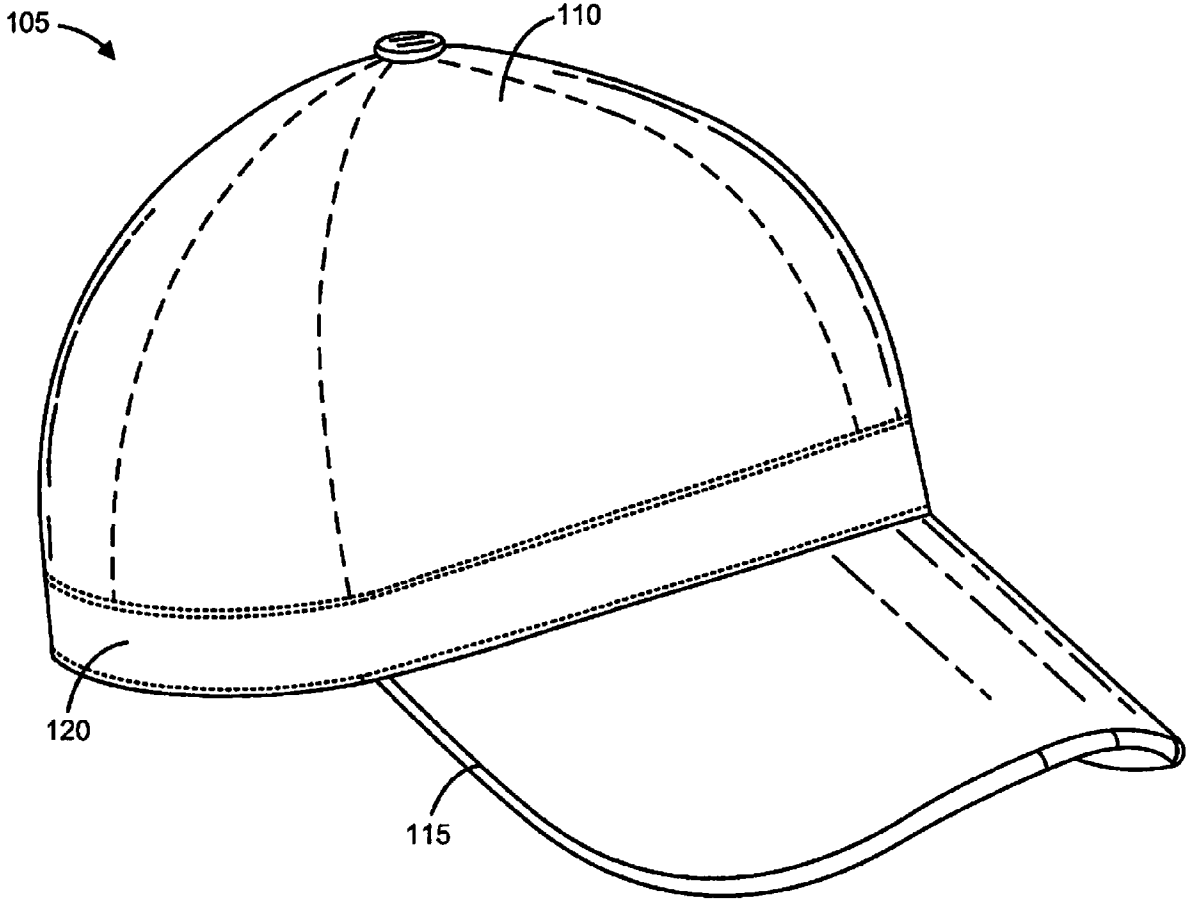
FIG. 1 shows a front, perspective view of a headwear member.
Figure 2:
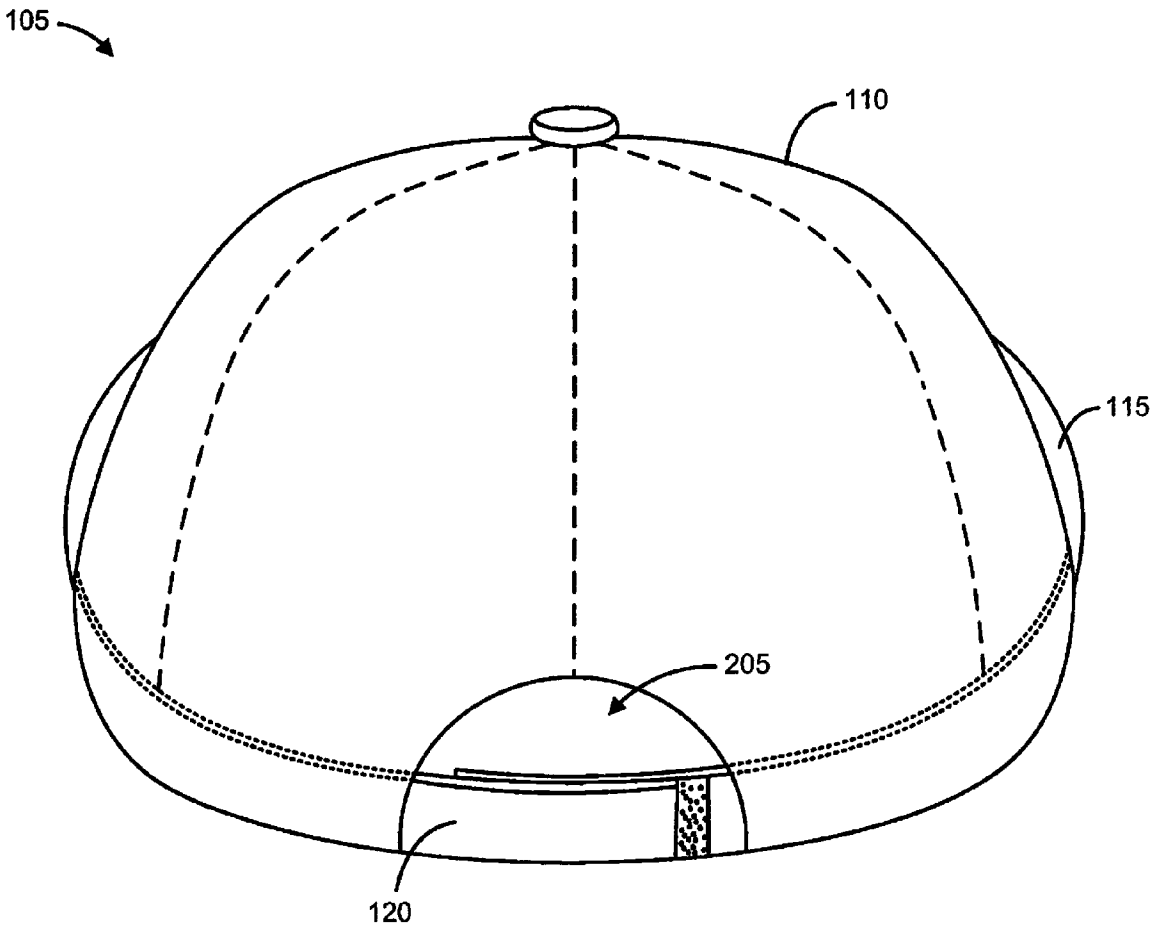
FIG. 2 shows a rear view of a headwear member.

FIGS. 1 and 2 show two views of a headwear member in the form of a baseball-type cap 105. It should be appreciated that FIGS. 1 and 2 show only one type of cap in the form of a baseball type cap. Headwear other than baseball caps may be substituted for the baseball cap 105 shown in FIGS. 1 and 2 without departing from the present disclosure. FIG. 2 shows a rear view of the cap, which is shown having a securing band type arrangement 200 on its rear side. The arrangement 200 includes a cut out 205 wherein two ends of a strip of material are secure to one another to adjust the size of the cap 105. It should be appreciated that other configurations are possible.

With reference to FIGS. 1 and 2, the baseball cap includes a crown 110 that is sized and shapes to fit on the head of a wearer. A visor or bill 115 extends outward from a forward edge of the cap 105 such as at the base of the crown 110. A band 120 extends around the periphery of the cap 105 such as along the base of the crown. The band 120 is shown in phantom lines to indicate that the band 120 is positioned on an inside region of the crown 110. The band 120 may be secured to the crown 110 in a variety of manners. The band 120 may be provided with printed characters, as described in detail below.

The band may be at least partially made of a material that is at least partially stretchable along its length or along a direction perpendicular or cross-wise to its length, as well as combinations thereof. Moreover, the band 120 includes a portion that may be printed on or stamped on with characters or graphics. It should be appreciated that variations of the cap 105 may be formed without a bill 115 without departing from the present disclosure.

The cap 105 may be configured according to any of a variety of baseball cap profiles. For example, the cap 105 may have a structured high-crown profile, a mid-crown profile, a mid-to-low crown profile, or an unstructured low-crown profile. The size and shape of the cap 10 may vary depending on the needs or preferences of the user. The crown 110 may have a unitary shell configuration or it may be a multi-gore or multi-panel shell configuration with the panels or gores attached to one another such as via stitching. The crown 110 may be formed in other manners without departing from the present disclosure.

Moreover, in an embodiment, the headwear is a visor-style headwear that lacks a crown.

The crown 110 may be constructed of any suitable material, including cloth, velvet, fabrics such as upholstery fabrics or moisture-wicking fabrics, lightweight wools, cotton, cotton blends, jersey, mesh, acrylic/wool blends, felt, synthetic material, plastic, leather, and/or any combination of these materials. The crown 110 may also include eyelets or small holes that permit a user's head to breathe when the cap 105 is worn. If present, the eyelets may be formed of any material.

The cap 105 may be single-colored or may include more than one color.

As mentioned, the cap includes a band 120 that extends around the periphery of the cap 105 such as along the base of the crown. In an embodiment, the band 120 is on an inside surface of the crown such that at least a portion of the band contacts the wearer's head when worn.

Figure 3:
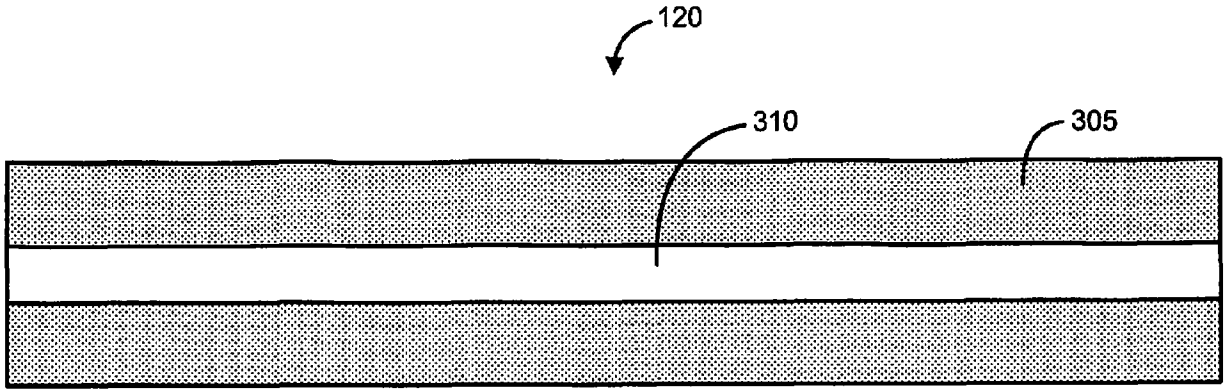
FIG. 3 shows a headband member of the headwear member.

FIG. 3 shows a front view of the band 120, which is formed of two strips of material that are secured to one another using a heating process. The band 120 includes a substrate or base band 305 formed of a material such as spandex. In an embodiment, the base band 305 is stretch nylon or stretch polyester. In another embodiment, the base band is 88% nylon and 12% spandex for stretch nylon. In another embodiment, the base band is 88% polyester and 12% spandex for stretch polyester. It should be appreciated that other materials may be used for the base band 305. In the illustrated embodiment, the base band 305 has a larger width than a width of an attached insert band 310.

An insert band 310 is positioned on the base band 305 and is attached to the base band such as by using a heating process, as described below. In another embodiment, sutures or adhesive are used. The insert band 310 is made of a material that can be stretched, such as silicone gel. The insert band may have a non-slip feel and it can be printed on or stamped on. The insert band 310 is secured to the base band by heating the two portions causing the insert band 310 to adhere to the base band. The insert band 310 may be secured to the base band 305 in a manner such that the insert band 310 is not removable from the base band 305 without destroying or damaging at least one of the insert band or base band. In another embodiment, the insert band 310 may be peeled from the base band 305 without any damage to one or the other.

The material of the insert band 310 is configured such that one or more characters may be printed, stamped, or otherwise placed on the insert band. The positioning of the characters or graphics on the insert band 310 may be done before or after the insert band 310 is attached to the base band 305.

Figure 4:
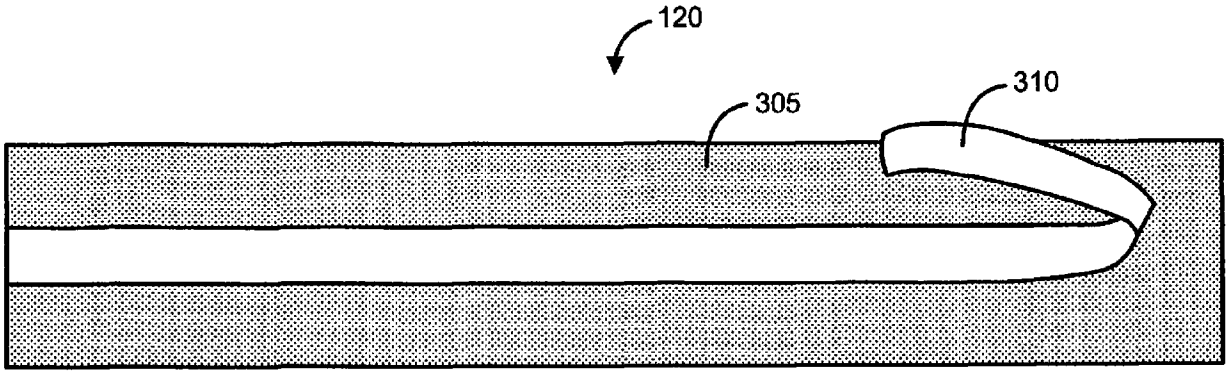
FIG. 4 shows the headband member in a partially disassembled state.
Figure 5:
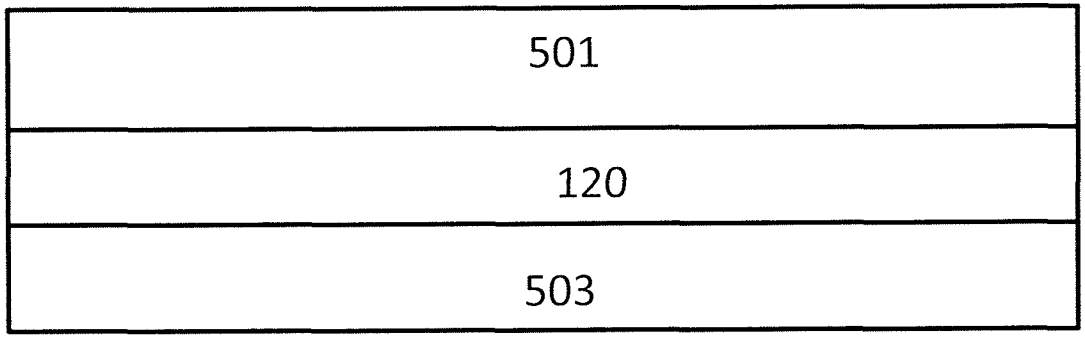
FIG. 5 shows a schematic cross-sectional view of the crown of the headwear member showing the band 120 positioned between layers 501 and 503 of the crown.

FIG. 4 shows the band 120 with the insert band 310 partially peeled apart from the base band 305. As shown in FIG. 4, the insert band 310 is juxtaposed on the base band 305 such that a rear side of the insert band 310 is positioned against a front side of the base band 310 when the band 120 is assembled.

The band 120 may be secured the crown 110 of the cap 105 in a variety of manners. For example, the band 120 may be sewed or secured to the crown 110. In another embodiment, the band 120 is at least partially positioned within two or more layers 501, 503 of a material that forms the crown.

A method of manufacturing the cap 105 is now described. First the crown 110 and the bill 115 are formed and attached to one another pursuant to any of a variety of methods. The band 120 is formed by first providing the base band 305 and the insert band 310. The base band 305 and insert band 310 are sized so that they may extend along at least a portion of the periphery of the crown 110. The insert band 310 is then secured to the base band 305 by providing heat to one or both of the insert band and base band while the insert band is positioned on the base band. In this manner, the insert band and base band are secured to one another. The assembled band 120 is then attached to the appropriate region of the crown 110.

As will be apparent to those of skill in the art upon reading this disclosure, each of the individual embodiments described and illustrated herein has discrete components and features which may be readily separated from or combined with the features of any of the other several embodiments without departing from the scope of the subject matter described herein. Any recited method can be carried out in the order of events recited or in any other order which is logically possible.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

The invention claimed is:

1. A headwear device, comprising: a crown that is sized and shaped to fit on a wearer's head;

a band positioned around at least a portion of the circumference of a base of the crown and permanently attached to the crown, the band comprising:

a base portion having a front surface;

an insert portion having a back surface juxtaposed with the front surface of the base portion, the insert portion being adhered with a heat attachment to the base portion without the use of a suture, and wherein the insert portion is made of silicon gel;

wherein the band has a width and wherein the insert portion has a width that is smaller than the width of the band, wherein the crown is formed of at least two layers of material, wherein the band is at least partially positioned within two layers of the material of the crown; and wherein the insert portion is secured to the base portion in a manner such that the insert portion is not removable from the base portion without destroying at least one of the insert portion and base portion.

2. A headwear device as in claim 1, wherein the headwear device is a baseball cap comprising a visor or bill.

3. A headwear device as in claim 1, further comprising a visor attached to the crown.

4. A headwear device as in claim 1, wherein the band is at least partially elastic.

5. A headwear device as in claim 1, wherein the base portion is elastic.

6. A headwear device as in claim 1, wherein the insert portion is elastic.

7. A headwear device as in claim 1, wherein the insert portion is made at least partially of nylon.

8. A headwear device as in claim 1, wherein the base is made at least partially of spandex.

9. A headwear device as in claim 1, wherein the base band is 88% nylon and 12% spandex.

10. A headwear device as in claim 1, wherein the base band is 88% polyester and 12% spandex.

11. A headwear device as in claim 1 wherein the band is stretchable both along its length and in a direction orthogonal to its length.

12. A method of manufacturing a hat, comprising:

forming a crown and a bill, the crown having at least two layers of material;

attaching the bill to the crown;

forming a base band having a front surface;

forming an insert band made of silicon gel having a back surface juxtaposed with the front surface of the base band;

attaching the insert band to the base band by applying heat so as to form a hat band without the use of a suture, wherein the hat band is positioned around at least a portion of the circumference of a base of the crown and permanently attached to the crown securing the hat band to a base region of the crown, wherein the hat band has a width and wherein the insert band has a width that is smaller than the width of the hat band;

and positioning the hat band within two layers of the material of the crown.

13. A method as in claim 12, further comprising the step of printing a character on the hat band.

* * * * *